US007164409B2

(12) United States Patent
Pasqualini et al.

(10) Patent No.: US 7,164,409 B2
(45) Date of Patent: Jan. 16, 2007

(54) WINDOW BRIGHTNESS ENHANCEMENT FOR LC DISPLAY

(75) Inventors: Giuseppe Pasqualini, Monza (IT); Carlo Casale, Busto Arsizio (IT)

(73) Assignee: Koninklijke Philips Electronics, N.V., Eindhoven (NL)

( * ) Notice: Subject to any disclaimer, the term of this patent is extended or adjusted under 35 U.S.C. 154(b) by 294 days.

(21) Appl. No.: 10/509,451

(22) PCT Filed: Mar. 11, 2003

(86) PCT No.: PCT/IB03/00925

§ 371 (c)(1),
(2), (4) Date: Sep. 28, 2004

(87) PCT Pub. No.: WO03/083816

PCT Pub. Date: Oct. 9, 2003

(65) Prior Publication Data

US 2005/0219197 A1 Oct. 6, 2005

(30) Foreign Application Priority Data

Apr. 2, 2002 (EP) ..... 02076301

(51) Int. Cl.
*G09G 3/36* (2006.01)

(52) U.S. Cl. ..... 345/102

(58) Field of Classification Search ..... 345/77, 345/87, 102, 204, 211, 212, 690
See application file for complete search history.

(56) References Cited

U.S. PATENT DOCUMENTS

| | | | | |
|---|---|---|---|---|
| 5,786,801 | A * | 7/1998 | Ichise | 345/102 |
| 5,978,041 | A * | 11/1999 | Masuda et al. | 348/563 |
| 6,078,302 | A | 6/2000 | Suzuki | |
| 6,980,195 | B1 * | 12/2005 | Lonoce et al. | 345/102 |
| 2003/0137484 | A1 * | 7/2003 | Bruning et al. | 345/102 |
| 2003/0146897 | A1 * | 8/2003 | Hunter | 345/102 |
| 2004/0104886 | A1 * | 6/2004 | Kawano | 345/102 |
| 2005/0219198 | A1 * | 10/2005 | Pasqualini et al. | 345/102 |

FOREIGN PATENT DOCUMENTS

| | | |
|---|---|---|
| WO | WO 9923456 | 5/1999 |

* cited by examiner

*Primary Examiner*—Sumati Lefkowitz
*Assistant Examiner*—Rodney Amadiz

(57) ABSTRACT

In a LCD monitor, a predetermined part (PA) of the displayed information is highlighted by causing the backlighting to produce more light. The area outside the predetermined area (PA) is kept at a substantially constant brightness by adjusting the video data driving the panel. The actual amount of light produced by the backlighting is measured to obtain a more constant brightness outside the predetermined area (PA).

5 Claims, 3 Drawing Sheets

WINDOW BRIGHTNESS ENHANCEMENT FOR LC DISPLAY

FIELD OF THE INVENTION

The invention relates to a display apparatus with a liquid crystal display (LCD) screen allowing enhanced display in a predetermined area. The invention further relates to a system comprising a computer and such a display apparatus, and to a method of displaying an enhanced predetermined area.

BACKGROUND OF THE INVENTION

From Philips computer monitors in the market the feature lightframe™ is known. This feature enables the user to select an area on the screen of a display device in which the brightness should be increased. This is especially advantageous if natural information is displayed in the area. Natural information comprises photos and films which typically have a lower resolution than synthetic information such as text. The perceptual quality of this low resolution information improves considerably by increasing the brightness. On the other hand, the brightness of the high resolution synthetic information should not be increased to avoid blurring.

Usually, the area is a window or a part of a window created by the operating system Microsoft Windows or by an application running on the operating system. The area to be enhanced is further referred to as enhancement area.

In cathode ray tubes, the increased brightness is created by increasing the beam current in the cathode ray tube locally in the high brightness area.

In liquid crystal displays, the maximum brightness is determined by the light output of the backlighting. If the light output of the enhancement area has to be increased, the light output of the backlighting has to be increased, and the data outside the enhancement area has to be adapted (dimmed) to keep the brightness substantially constant outside the enhancement area.

SUMMARY OF THE INVENTION

It is an object of the invention to provide a LCD wherein a change of a property of the light generated by the backlighting is less visible in the area outside the enhancement area.

A first aspect of the invention provides a LCD as claimed in claim 1. A second aspect of the invention provides a system as claimed in claim 4. A third aspect of the invention provides a method as claimed in claim 5. Advantageous embodiments are defined in the dependent claims.

In the Light Frame implementation in LCD monitors, only part of the picture on the screen has to be highlighted while the remaining part of the screen has to be dimmed by adjusting the data driving the LCD panel.

The invention aims at decreasing the visibility of the transition in a property of the light generated by the backlighting in the area outside the enhanced area. For example, a transition from a non-enhanced situation to an enhanced situation may be an increased brightness in the enhanced area. More generally, all changes of a property of the light generated by the backlighting may cause an enhancement in the enhanced area. For example, a more red white point may give an improved (warmer) impression of the display of the picture in the enhanced area.

When the brightness should be increased in the enhancement area, the backlighting has to produce an increased amount of light. Because the display outside the enhanced area should not change, the data supplied to the LCD panel is adapted to compensate for the increase of the brightness. If this compensation is not good enough, the user perceives a (temporary) change in the information displayed outside the enhanced area.

The invention is based on the recognition that the quality of the compensation depends on the actual amount of change of the property of the backlight. A perfect compensation in the area outside the enhanced area is possible only if this actual amount is known. Therefore, a property of the light generated by the backlight unit is measured by a light sensitive element. The measured change in the property of the light is used for compensating the change in the area outside the enhancement area.

In an embodiment of the invention as claimed in claim 2, if the brightness of the light is increased, the data driving the LCD panel is adapted (dimmed) in conformance with the measured change in the amount of light generated. The compensation will be improved with respect to the prior art wherein the exact amount of the change of the brightness is not known.

In another embodiment of the invention as claimed in claim 3, the speed of the change in the brightness of the light is increased by using the measurement of the actual amount of light generated. The lamp driver is controlled to adapt the duty cycle and/or the lamp current such that the final state is reached in a short period of time.

A typical backlight lamp driver architecture is disclosed in U.S. Pat. No. 6,078,302. A lamp driver circuit current intermittently supplies a current to the backlight lamp. The optimal drive current is generated by a current source. The current source supplies the current to the lamp unit via a controlled switch. A pulse width controller controls the switch to perform a pulse width control of the drive current. The ratio between the on-time of the switch and the sum of the on- and off-time of the switch is the duty cycle. Usually, the duty cycle determines the brightness of the light. The current is selected to have a fixed optimal value fitting a specific lamp. The duty cycle or pulse width can be manually adjusted by a user via a brightness control input.

In this embodiment of the invention, the actual light output is measured. During a transition to a higher brightness, the speed of change of the amount of light is observed. If the speed of change is too low, the duty cycle is increased further, or if the duty cycle is at maximum, the current is temporary increased. Further, it is possible to reach the final state in a smooth way, without an overshoot in the light output. A suitably programmed microprocessor may receive the measured light output and produce the control signals for controlling the duty cycle and the current.

The program may comprise learning facilities: the duty cycle is changed, the effect is determined from the measured light output. If the change is too slow, the current is adapted. Again the effect is determined from the measured light output, and the amount of the change of the current may be adapted. It is possible to take limits imposed on the current into account. The optimal settings of a required change in the duty cycle and the current for a predetermined change in the light output may be stored in a memory. It is also possible to store the optimal settings in a memory on beforehand, the learning facilities are not required in this case.

Without speeding up the transition, it takes several seconds to increase the brightness of the light produced by the lamp. This causes several problems.

First, outside the area in which the higher brightness is required, it is difficult to compensate the slow increase of the light output of the lamp by slowly adapting the display signal. The response of the lamp depends on the characteristics of the lamp used, and on the actual status of the lamp (for example its temperature). Further, the compensation is difficult because of the non-linear behavior of the cells of the liquid crystal display.

Secondly, the user will become confused when it takes several seconds for a selected portion of the displayed information to become enhanced. Usually, the user will move a mouse pointer over the selected portion, activate the mouse button, and expect an immediate response. If the response is not visible after a few seconds, the user expects that he did something wrong, or that the lightframe feature is not working properly.

With the measurement of the actual light output and the speed up of the transition, it takes a few milliseconds only to change the brightness. Preferably, a temporary additional current through the lamp is generated when an increase of the light output is required, or less current is supplied to the lamp temporary when a decrease of the light output is required. This additional or subtractive current amount causes the lamp to reach the steady state brightness value much faster. In this way, the lamp is controlled such that the amount of light produced by the backlighting changes very fast and the user does not notice a transition in the area outside the enhanced area due to the compensation of the changed light output of the backlighting by the adaptation of the data.

WO99/23456 discloses a LCD in which the light output of the backlighting is measured and the lamp driver is controlled to keep the light output of the backlighting constant over its lifetime.

These and other aspects of the invention are apparent from and will be elucidated with reference to the embodiments described hereinafter.

DETAILED DESCRIPTION OF THE PREFERRED EMBODIMENT

In the Figures, the same references refer to the same elements.

Figure 1:
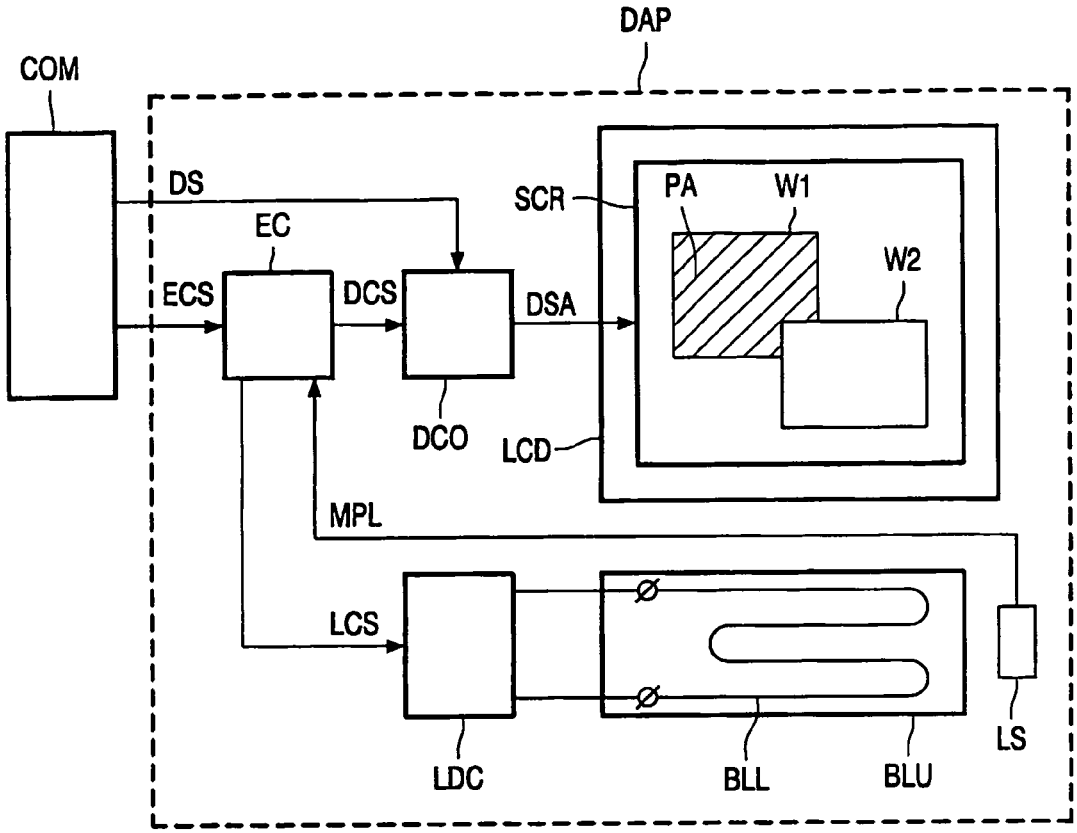
FIG. 1 shows a system of a computer and a display apparatus in accordance with the invention.

FIG. 1 shows a system of a computer COM and a display apparatus DAP in accordance with the invention. The computer COM supplies a display signal DS to be displayed on a display apparatus DAP with a liquid crystal display LCD. The computer COM further generates an enhancement control signal ECS which indicates a required enhancement (for example, an increased brightness) of a predetermined area PA on a screen SCR of the liquid crystal display LCD. The predetermined area PA is, for example, shown as a window W1 generated by the operating system or an application. The window may be partly covered by a window W2 as is shown.

The display apparatus DAP further comprises an enhancement controller EC which receives the enhancement control signal ECS to supply a data control signal DCS to a data controller DCO and to supply a light control signal LCS to a lamp driver circuit LDC.

A backlighting unit BLU comprises a backlighting lamp BLL which illuminates the liquid crystal display LCD. The lamp driver circuit LDC drives the backlighting lamp BLL to change a property of the light generated when the light control signal LCS indicates that the property should change.

The data controller DCO receives the display signal DS and the data control signal DCS to generate an adapted display signal DSA such that a substantially unchanged display outside the predetermined area PA is obtained when the enhancement control signal ECS indicates that the enhancement is required. The adapted display signal DSA is supplied to the liquid crystal display LCD. In this way, outside the predetermined area PA, a brightness change of the lamp BLL is compensated by adapting the display signal DS.

The display apparatus DAP further comprises a light sensor LS which senses the amount of light generated by the backlighting lamp BLL. The enhancement controller EC receives the measured light output MPL and generates the data control signal DCS and the light control signal LCS accordingly.

The measurement of the amount of light MPL generated by the backlighting lamp BLL enables the enhancement controller EC to exactly calculate the required adaptation of the data signal DS such that the light output outside the predetermined area PA is kept constant. The required adaptation of the data signal DS is indicated in the data control signal DCS, as will be elucidated in more detail with respect to FIG. 2.

Figure 3:
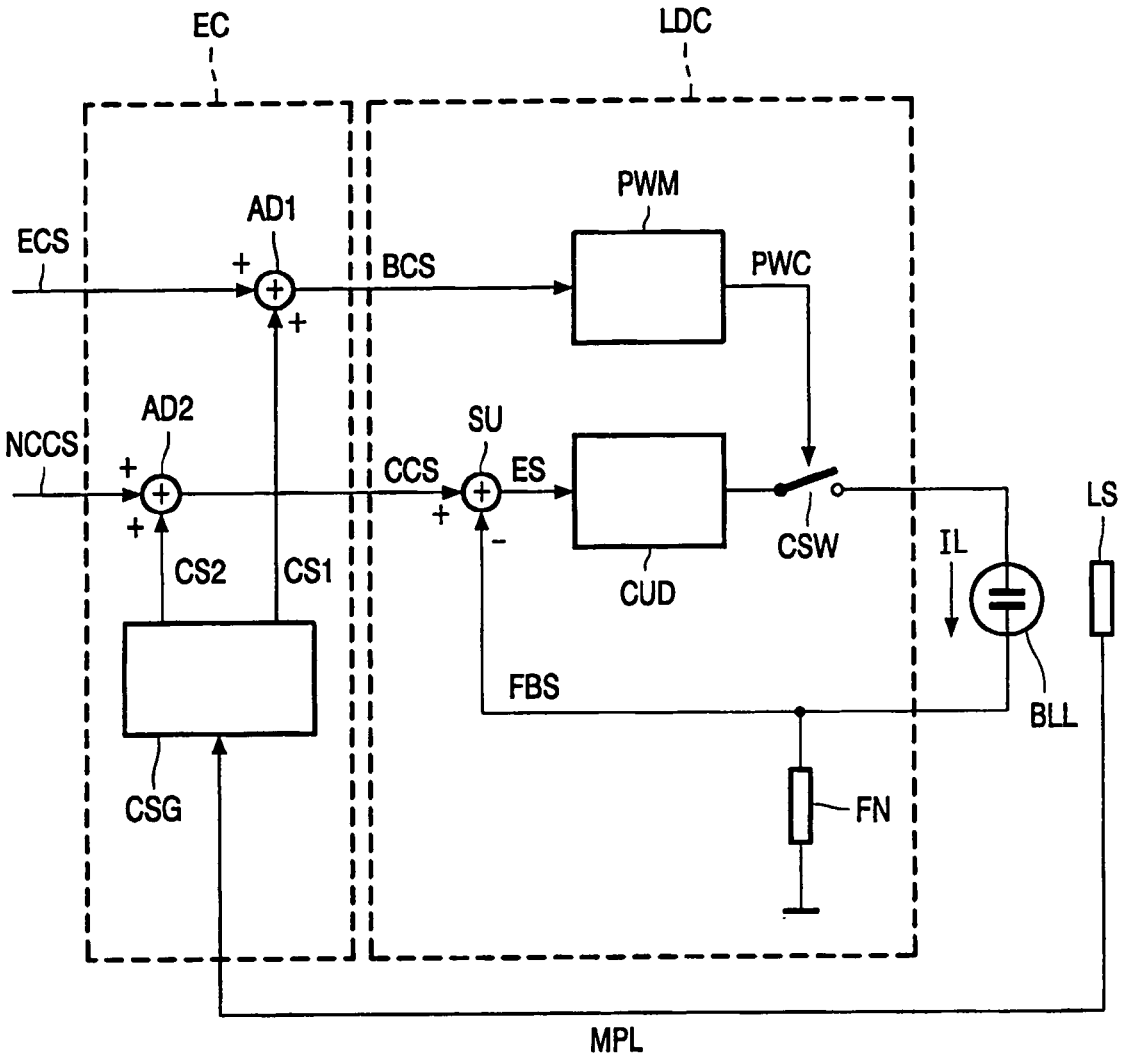
FIG. 3 shows an embodiment of an enhancement controller and a lamp driver circuit in accordance with the invention.

Alternative or in conjunction, the measurement of the light output enables a decrease of the time required to change the light output of the backlighting lamp BLL as will be elucidated with respect to FIG. 3.

Figure 2:
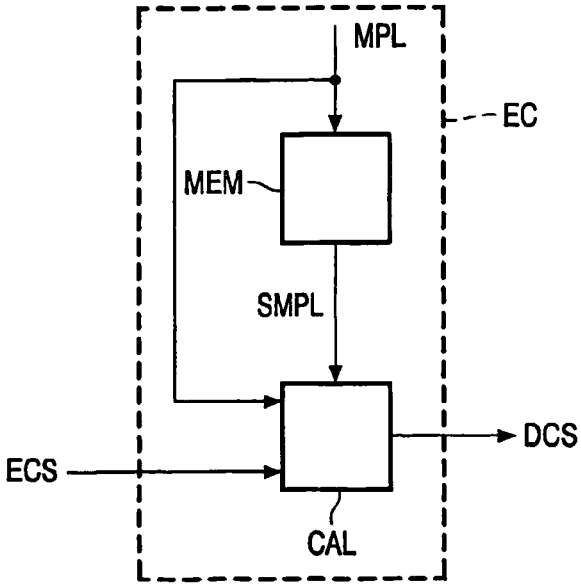
FIG. 2 shows an embodiment of an enhancement controller in accordance with the invention.

FIG. 2 shows an embodiment of an enhancement controller EC in accordance with the invention.

The enhancement controller EC comprises a memory MEM and a calculating unit CAL. The memory MEM stores the property of the light before the transition of the property to obtain a stored property of the light SMPL. The calculating unit CAL compares the stored property SMPL with the actual measured property MPL and calculates the data control signal DCS such that the data outside the predetermined area PA is displayed unchanged.

If, for example, the transition is an increase in the brightness of the backlighting lamp BLL, the amount of light generated before the transition is stored in the memory MEM. The calculating unit CAL, which preferably is a micro computer or a micro processor, compares the stored amount with the actually measured amount of light generated by the backlighting lamp BLL after the transition. The data control signal DCS indicates the amount the data has to be dimmed to obtain the same display of the part of the data signal DS outside the predetermined area.

FIG. 3 shows an embodiment of an enhancement controller EC and a lamp driver circuit LDC in accordance with the invention.

The lamp driver circuit LDC comprises a pulse width converter PWM, a subtractor SU, a current driver CUD, a controllable switching device CSW, and a feedback element or circuit FN.

The feedback circuit FN is arranged in series with the lamp BLL to supply a feedback signal FBS which represents the lamp current IL.

The subtractor SU subtracts the feedback signal FBS from the current control signal CCS to supply an error signal ES to the current controller CUD. The current control signal CCS determines the steady state current IL supplied to the lamp BLL. The steady state value of current IL is selected to optimally fit the properties of the lamp BLL. Important considerations are the lifetime of the lamp BLL, and the brightness and the color of the light produced.

The current controller CUD supplies the lamp current IL via the controllable switch CSW to the lamp BLL. The on/off switching of the controllable switch CSW is controlled by the pulse width modulator PWM. The pulse width modulator PWM generates a pulse width control signal PWC which has a duty cycle dependent on the brightness control signal BCS. The brightness control signal BCS may be user controllable (not shown).

In the steady state, the current IL through the lamp BLL is determined by the current control signal CCS. The current IL determines the brightness and/or the color temperature of the light emitted by the lamp BLL. It is therefore important that the current IL is kept accurately at the desired value. The current is kept at the desired value indicated by the current control signal CCS by the closed current feedback loop which comprises the subtractor SU, the current controller CUD, and the feedback element FN. Usually, the feedback element FN is a resistor through which the current IL generates a feedback voltage as the feedback signal FBS. The subtractor SU compares the actual measured current IL through the lamp BLL with the desired current as indicated by the current control signal CCS to control the current controller CUD in a known manner to keep the current EL accurately at the desired value.

The brightness of the lamp BLL is controlled by the duty cycle of the controllable switch CSW. The current IL flows through the lamp BLL only during the time that the switch CSW is closed. If this time is short (the duty cycle is small) with respect to the time that the switch CSW is open, the brightness is low. Usually, the user controllable brightness input which generates the user controllable brightness control signal BCS controls the duty cycle via the pulse width modulator PWM.

To conclude, the actual lamp brightness value is obtained by controlling the duty cycle. During the on state of the lamp BLL, the current IL is regulated by the closed control loop at a desired nominal value which may be different for different lamp types.

The enhancement controller EC comprises a first adder AD1, a second adder AD2, and a control signal generator CSG.

The control signal generator CSG is connected to the light sensor LS to receive the measured property of the light MPL generated by the backlighting. Based on the measured property MPL, the control signal generator CSG determines a first control signal CS1 and a second control signal CS2.

The first adder AD1 receives the enhancement control signal ECS (which may be the brightness control signal BCS) and the first control signal CS1, the second adder AD2 receives the nominal current control signal NCCS and the second control signal CS2.

In the lightframe application the backlight lamp brightness has to be switched from one value to another. As elucidated before, a fast response time of the resulting brightness is required.

The control signal generator CSG receives the actual measured property of the light MPL from the light sensor LS. By way of example, a transition to a higher brightness is elucidated in detail now. However, the invention is not limited to a change in brightness, any change of a property of the light produced by the lamp BLL may be processed in a similar way.

The enhancement control signal ECS indicates when a higher brightness is required in the predetermined area PA. Usually, the enhancement control signal ECS is combined with the user brightness setting. Thus, the enhancement control signal ECS indicates the required brightness of the light produced by the lamp BL. If no enhancement is required, the user defined brightness is indicated, and when the lightframe feature indicates that the brightness increase of the predetermined area PA has to be activated, the enhancement control signal ECS jumps to a higher value. This higher value may indicate that the amount of light produced by the lamp will increase a fixed predefined amount. It is also possible that the higher value indicates the amount of the desired increase of the light output of the lamp BL.

During a transition to a higher brightness, the control signal generator CSG which receives the measured light output from the light sensor, observes the speed of change of the amount of light. If the speed of change is too low, the control signal generator CSG outputs the first control signal CS1 which is added to the enhancement control signal ECS to supply the brightness control signal BCS to further increase the duty cycle. If the duty cycle is at maximum or reaches the maximum value and the speed of change is still too low, the current IL is temporary increased.

Therefore, the control signal generator CSG produces the second control signal CS2 which is added to the nominal current control signal NCCS to obtain the current control signal CCS which controls the current driver CUD to increase the current IL through the lamp BLL. This additional current should only flow a short period of time required to speed up the transition. After this short period of time, the current IL should return to its optimally selected nominal value as indicated by the nominal current control signal NCCS. In this manner, it is possible to reach the new state of the light output in a short period of time.

Because the control signal generator receives the actual light output of the lamp BLL, it is possible to control the lamp BLL in a defined and smooth way, without an overshoot in the light output generated. For example, a suitably programmed microprocessor may receive the measured light output MPL and produce the control signals CS1 and CS2 for controlling the duty cycle and the current IL. The program comprises learning facilities: the duty cycle is changed, the effect is determined from the measured light output MPL. If the change is too slow, the current IL is adapted. Again the effect is determined from the measured light output MPL, and the amount of the change of the current IL may be adapted. It is possible to take limits imposed on the maximum and/or minimum current IL into account. The optimal settings of a required change in the duty cycle and the current IL for a predetermined change in the light output may be stored in a memory. If the learning facilities are not implemented, the optimal settings may be stored in a memory on beforehand.

The light control signal LCS referred to in FIG. 1 comprises the brightness control signal BCS and the current control signal CCS.

Figure 4:
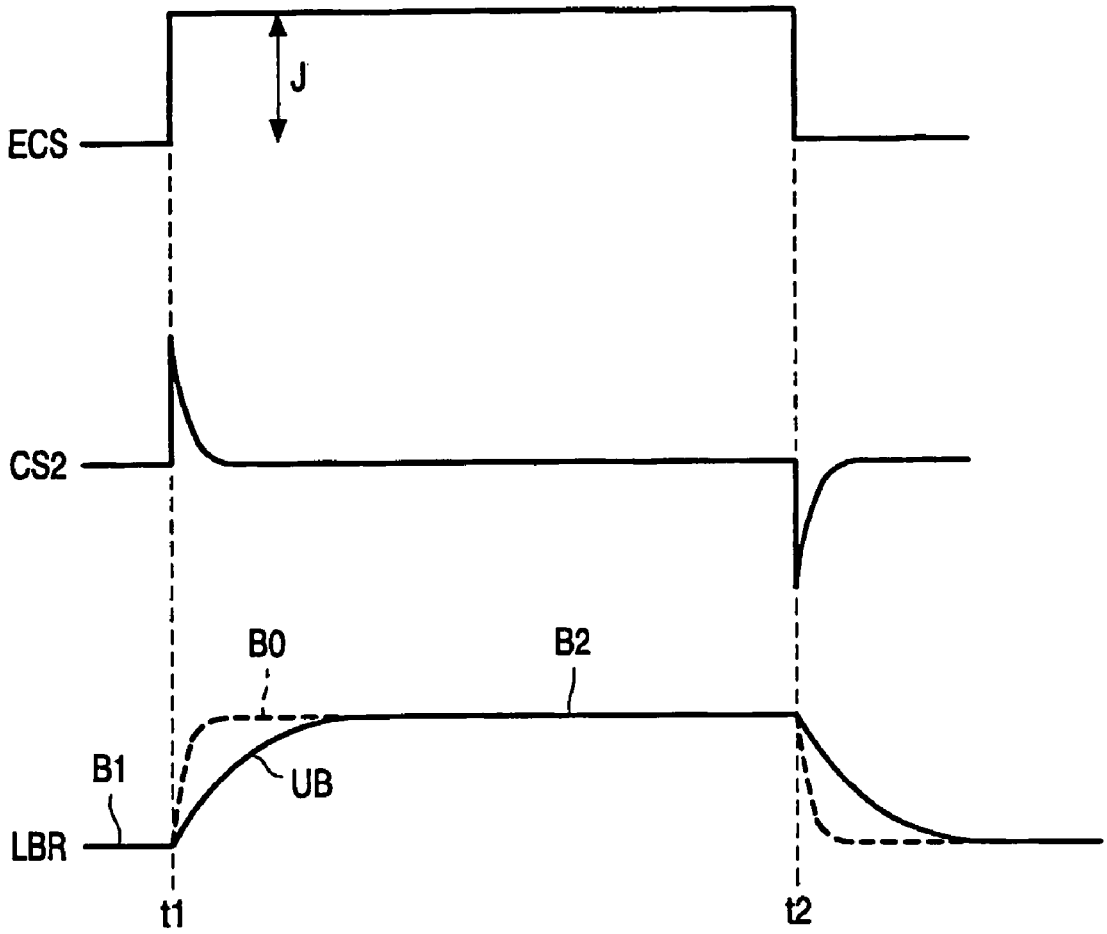
FIG. 4 shows waveforms elucidating the operation of an embodiment of the backlighting unit in accordance with the invention.

FIG. 4 shows waveforms elucidating the operation of an embodiment of the backlighting unit in accordance with the invention. FIG. 4 shows the enhancement control signal ECS, the control signal CS2, and the brightness LBR of the lamp BLL.

Before the instant t1, the enhancement control signal ECS, which in this situation is the brightness control signal BCS has a value indicating a first brightness level (no enhancement is required). The enhancement control signal ECS is zero and the brightness LBR has a level B1.

At the instant t1, the enhancement control signal ECS makes a jump J to a value indicating a second brightness level (the enhancement, which is in this example a higher brightness, is required). Without speeding up the transition, the control signal CS2 stays zero, and it takes a considerable amount of time before the brightness LBR reaches the second level B2, as is shown by the waveform indicated by UB. With speeding up of the transition, the control signal CS2 shows a spike like waveform.

The control signal generator CSG may generate this spike by differentiating the enhancement control signal ECS if from stored data it is clear that a change of the duty cycle, if not already at its maximum value, will not suffice to reach the new light output level fast enough. In this embodiment in accordance with the invention, the control signal generator CSG does not use the measured light output MPL. The measured light output MPL is used only in the data controller DCO to calculate the required compensation of the data outside the predetermined area PA which has to be enhanced.

It is also possible that the control signal generator CSG generates this spike based on the stored data triggered by the sudden change of the value of the enhancement control signal ECS.

The control signal generator CSG may start the spike in response to the sudden change of the value of the enhancement control signal ECS, and determine the shape of the spike based on minimizing the transient time by using the measured light output MPL. It is further possible to add a self adapting behavior by storing the optimal control values of the control signals CS1 and CS2 found to correspond with a specific change of the value of the enhancement control signal ECS. These stored control values are used the next time that the same or almost the same change of the value of the enhancement control signal ECS occurs. If the measurement of the light output indicates that the light output does not change according to the desired curve, the control signals CS1 and CS2 may be adapted to obtain a better match of the desired curve. The new control values may be stored again for future use.

The spike causes a corresponding spike in the current IL through the lamp BLL and the second brightness level will be reached much faster as is shown by the partly dashed waveform BO.

At the instant t2, in a same way, the brightness LBR of the lamp BLL is decreased within a short time.

To conclude, usually, if the enhancement control signal ECS is the brightness control signal BCS, and in a predetermined area PA a higher brightness is required, the steady state brightness of the lamp BLL is increased by increasing the duty cycle. The fast transition in the light output is obtained by temporary boosting the current IL through the lamp BLL.

It should be noted that the above-mentioned embodiments illustrate rather than limit the invention, and that those skilled in the art will be able to design many alternative embodiments without departing from the scope of the appended claims. For example, the lamp BLL may be a single lamp, or a may comprise multiple lamps. The feedback element FN may be a current transformer. It is possible to highlight several areas. The areas may have a non rectangular shape. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A display apparatus (DAP) comprising:

a liquid crystal display (LCD) for receiving an input display signal (DS) to display an adapted display signal (DSA) being enhanced within a predetermined area (PA) of a display screen (SCR) of the liquid crystal display (LCD) in response to an enhancement control signal (ECS), a lamp driver circuit (LDC) for changing a property of the light emitted by a backlighting lamp (BLL) illuminating the liquid crystal display (LCD), under control of a light control signal (LCS), a data controller (DCO) for adapting the display signal (DS) under control of a data control signal (DCS) to obtain a substantially unchanged display on the display screen (SCR) outside the predetermined area (PA), a light sensor (LS) for measuring the property of the light to obtain a measured property of the light (ML), and an enhancement controller (EC) comprising a first input for receiving the enhancement control signal (ECS) and a second input coupled to the light sensor (LS), for adapting the data control signal (DCS) and the light control signal (LCS), both in response to the enhancement control signal (ECS), and for determining the data control signal (DCS) and/or the light control signal (LCS) in correspondence with the measured property of the light (MPL).

2. A display apparatus as claimed in claim 1, characterized in that the enhancement controller (EC) further comprises:

a memory (MEM) for storing the measured property of the light during a period in time that the enhancement control signal (ECS) indicates that no enhancement is present, and a calculating circuit (CAL) for calculating a value of the data control signal (DCS) based on the stored measured property (SMPL) and a measured property (MPL) of the light after an instant the enhancement control signal (ECS) indicates that the enhancement is present.

3. A display apparatus as claimed in claim 1, characterized in that the property of the light is the brightness, and in that the lamp driver circuit (LDC) comprises:

a pulse width modulator (PWM) for generating a pulse width control signal (PWC) having a duty cycle dependent on a brightness control signal (BCS), a series arrangement of a current driver (CUD), a switching device (CSW), and the backlighting lamp (BLL), the current driver (CUD) has an input for receiving a current control signal (ES) and an output for supplying a predetermined current (IL) to the backlighting lamp (BLL) when the switching device (CSW) is closed, the switching device (CSW) has a control input for receiving the pulse width control signal (PWC) to determine on and off times of the switching device (CSW), and the enhancement controller (EC) further comprises:

a control signal generator (CSG) for generating the light control signal (LCS) comprising the brightness control signal (BCS) and the current control signal (CCS) based on the enhancement control signal (ECS), and wherein during a transition of the brightness, the brightness control signal (BCS) is adapted to change the duty cycle, and if the transition is not proceeding fast enough, the current control signal (CCS) is adapted to temporary change the current (IL) through the backlighting lamp (BLL).

4. A system comprising a display apparatus (DAP), and a computer (COM) for generating a display signal (DS) and an enhancement control signal (ECS) indicating a required enhancement of the display signal (DS) within a predetermined area (PA) on a display screen (SCR) of the display apparatus (DAP), the display apparatus (DAP) comprising:

a liquid crystal display (LCD) for receiving an input display signal (DS) to display an adapted display signal (DSA) being enhanced within a predetermined area (PA) of the display screen (SCR) of the liquid crystal display (LCD) in response to an enhancement control signal (ECS), a lamp driver circuit (LDC) for changing a property of the light emitted by a backlighting lamp (BLL) illuminating the liquid crystal display (LCD), under control of a light control signal (LCS), a data controller (DCO) for adapting the display signal (DS) under control of a data control signal (DCS) to obtain a substantially unchanged display on the display screen (SCR) outside the predetermined area (PA), a light sensor (LS) for measuring the property of the light to obtain a measured property of the light, and an enhancement controller (EC) comprising a first input for receiving the enhancement control signal (ECS) and a second input coupled to the light sensor (LS), for adapting the data control signal (DCS) and the light control signal (LCS), both in response to the enhancement control signal (ECS), and for determining the data control signal (DCS) and/or the light control signal (LCS) in correspondence with the measured property of the light (MPL).

5. A method of enhancing a predetermined area (PA) of a display screen (SCR) of a liquid crystal display (LCD) in response to an enhancement control signal (ECS), the method comprising:

changing (LDC) a property of light emitted by a backlighting lamp (BLL) illuminating the liquid crystal display (LCD), under control of a light control signal (LCS), adapting (DCO) a display signal (DS) under control of a data control signal (DCS) to obtain a substantially unchanged display on the display screen (SCR) outside the predetermined area (PA), measuring (LS) the property of the light, and receiving (EC) the enhancement control signal (ECS) and the measured property of the light (MPL) for adapting (EC) the data control signal (DCS) and the light control signal (LCS), both in response to the enhancement control signal (ECS), and for determining (EC) the data control signal (DCS) and/or the light control signal (LCS) in correspondence with the measured property of the light (MPL).

* * * * *